US007185618B1

(12) United States Patent
Edelmayer

(10) Patent No.: US 7,185,618 B1
(45) Date of Patent: Mar. 6, 2007

(54) SHEET METAL ROCKER ARM WITH INTEGRALLY FORMED CROSS MEMBER

(75) Inventor: Thomas C. Edelmayer, Battle Creek, MI (US)

(73) Assignee: GenTek Technologies Marketing Inc.

( * ) Notice: Subject to any disclaimer, the term of this patent is extended or adjusted under 35 U.S.C. 154(b) by 0 days.

(21) Appl. No.: 11/306,838

(22) Filed: Jan. 12, 2006

(51) Int. Cl.
*F01L 1/18* (2006.01)

(52) U.S. Cl. ..... 123/90.39; 123/90.16; 74/559; 29/888.2

(58) Field of Classification Search ..... 123/90.16, 123/90.2, 90.39, 90.44; 74/559, 567, 569; 29/888.2
See application file for complete search history.

(56) References Cited

U.S. PATENT DOCUMENTS 6,601,555 B2 * 8/2003 Okubo et al. ..... 123/90.39
6,932,040 B2 8/2005 Kadokawa

* cited by examiner

*Primary Examiner*—Ching Chang
(74) *Attorney, Agent, or Firm*—Arthur J. Plantamura

(57) ABSTRACT

A sheet metal rocker arm of the welded and brazed tube and "boat type" rocker arm formed from sheet metal and characterized by having a reinforcing cross member which is integrally formed from a tab created by slitting the tube insert and which yields a unitary structure that introduces substantially greater stiffness to the rocker arm. The tube may be optionally rolled from sheet metal or by using seamless tubing. The method of creating integrally formed reinforcing cross-members by appropriate lancing slits in the sheet metal can be applied to any stamped rocker arm that has a U-channel architecture, e.g., including, for example, rocker arms for pushrod type valve trains as well as roller finger follower type rocker arms. Provision of the integrally formed cross member renders stiffness to the rocker arm that enables an engine to operate at a higher rpm and thereby to produce more horsepower.

9 Claims, 3 Drawing Sheets

SHEET METAL ROCKER ARM WITH INTEGRALLY FORMED CROSS MEMBER

DESCRIPTION

This invention relates to an improved rocker arm formed from sheet metal and characterized by an integrally formed cross member which provides advantageous added stiffness to the rocker arm.

BACKGROUND OF THE INVENTION

Generally, prior art rocker arms formed from sheet metal are provided with an opening in the center, flat section and then bent to a U-shape. The U-channel can be oriented up or down and is provided with an opening or "window" at the center, either for a pivot attachment or for mounting a rolling element bearing. The window is made by punching out the material and discarding the punched out portion.

Prior art rocker arms stamped from sheet metal typically have a U-shaped lateral cross-section and have no cross members between opposing sides. Under load or when stressed these rocker arms deflect such that opposing sides move outward and their ends move upwards, resulting in a loss of longitudinal stiffness. Lack of stiffness in rocker arms detracts from efficiency especially when operating at high engine speeds. The buckling, insufficiency of rocker arm stiffness also detracts from the capability to achieve maximum engine power.

Accordingly, there is a definite advantage in providing an economical and expeditious means for providing a sheet metal rocker arm possessing greater relative stiffness by an improved construction configuration.

SUMMARY OF THE INVENTION

The invention provides an improved rocker arm of the welded and brazed tube and "boat type" rocker arm formed from sheet metal and characterized by having a cross member which is integrally formed from the tube insert and which yields a unitary structure that introduces substantially greater stiffness to the rocker arm. The tube may be optionally rolled from sheet metal or by using seamless tubing. The method of the invention can be applied to any stamped rocker arm that has a U-channel architecture, e.g., including, for example, rocker arms for pushrod type valve trains as well as roller finger follower type rocker arms. Provision of the integrally formed cross member renders stiffness to the rocker arm and enables an engine to operate at a higher rpm and thereby to produce more horsepower.

In the rocker arm forming method of the invention, an opening or "window" is formed in a flat patterned sheet metal piece wherein window portions of the sheet metal are punched out and discarded. The sheet metal piece is then bent into a U-shape precursor. In creating the desired reinforcing cross-member the seamless tube or rolled sheet metal is slit to form tabs and after insertion in the U-shape precursor window, the tabs are bent to provide cross-members. This piercing of the sheet metal as in the present invention without punching out and removing the material is referred to as lancing. The tab or tabs according to the method of the invention are then bent such that the tab ends contact the sides of the U-shape precursor. It should be noted that most rocker arms are shaped as to be narrower at each end than at the center where the window is contained. In the invention, the tab created by the slots in the tube insert that configures the cross-member is bent far enough so that edges of the tab can be brazed, welded or otherwise secured to the inside walls of the rocker arm.

DETAILED DESCRIPTION OF THE INVENTION

The rocker arm of the invention is produced by the sheet metal stamping process. During a conventional sheet metal stamping process, openings are created in one or more surfaces by material removal, i.e., by punching out a "window." In accordance to the method of the invention for making a tube and "boat type" rocker arm from sheet metal, essentially no material is removed in forming the opening in the tube insert, except for material that may be required to provide die clearance. Instead, the opening is formed by making slits from which bent tabs are created. Material at the slit portion instead are bent to create reinforcing cross-members connected to the interior sides of the rocker arm. An opening in the tube insert that comprises a U-shaped slit, i.e., either 42 or 44 in FIG. 3, results in forming a single cross member, whereas an H-shaped slit comprising both 42 and 44 in FIG. 3 results in a pair of cross members. The system of the invention, accordingly, is distinguished by cutting, i.e., slitting, an outline to form the intended opening, or window after which the tab or tabs are bent in a subsequent assembly operation, wherein the tab, conforming to the slit is bent outward and in contact with the interior sides of the rocker arm, forming either, respectively, one or two cross-members which are joined at their edges to the sides of the adjacent rocker arm interior surfaces by staking, welding, brazing, etc. The addition of this formed-in-place cross-member improves the structural integrity of the rocker arm and, most importantly, increases stiffness; high rocker arm stiffness is essential for operation at high engine speeds necessary to achieve maximum engine power.

The method of the invention is applicable to rocker arms used in overhead cam valve trains described as end-pivot, center-pivot and in cam-in-block pushrod valve trains as well as roller finger follower rocker arms. All of these rocker arm types will benefit from the stiffness derived by the addition of formed-in-place cross members. Though only one type of pushrod valve train rocker arm is illustrated, the method of the invention for creating an integrally formed cross-member is essentially the same for all types in addition to the described welded and brazed assembly of a tube and a "boat-type" rocker arm.

Figure 1:
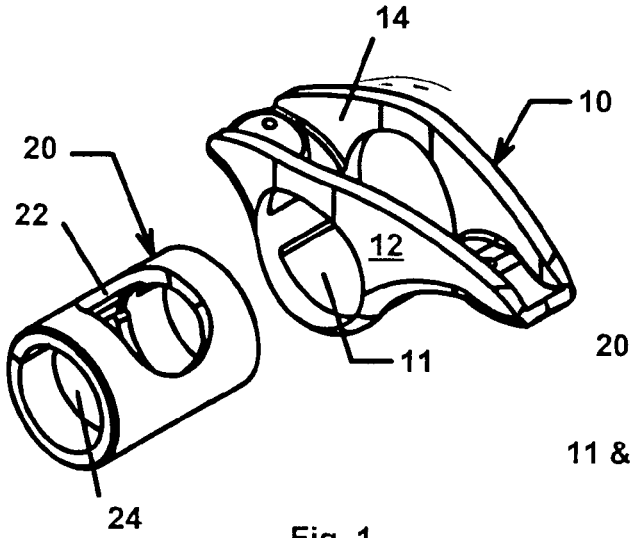
Fig. 1 Prior Art
FIG. 1 and FIG. 1*a* depict an exploded and an assembled view, respectively, of a prior art U-channel sheet metal formed rocker arm that has a tube assembled into it and wherein the tube has two windows, one above the other.
Figure 1A:
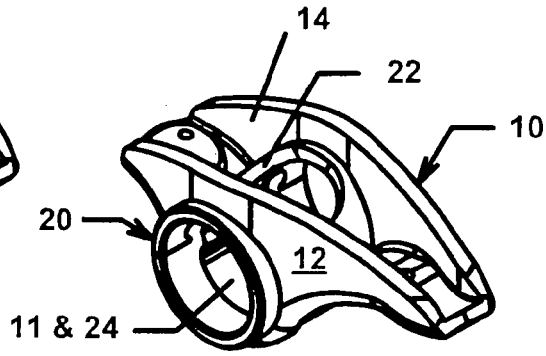
Fig. 1a Prior Art

Referring in particular to the drawings, FIG. 1 and FIG. 1*a* depict an exploded and an assembled view, respectively, of a conventional prior art rocker arm 10 wherein no cross-members are present between opposing sides 12 and 14 of the rocker arm. A tube 20 preformed with punched out windows 22 and 24 is inserted, aligning the window 24 with the rocker arm window 11, and secured within the opening 15 formed in the central portion of and through the sides 12 and 14 of the rocker arm 10.

Figure 2:
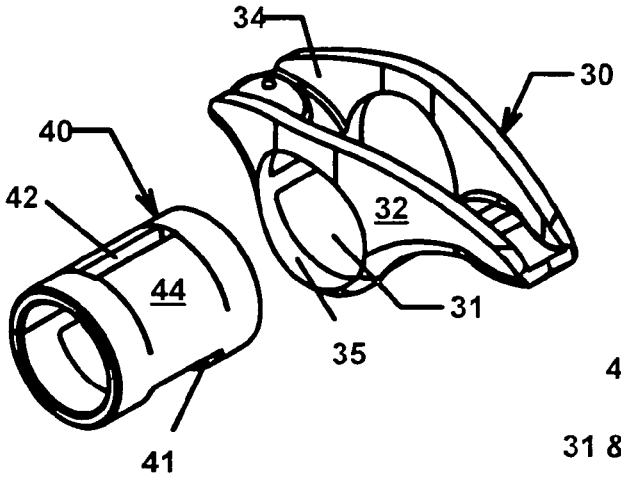
FIG. 2 and FIG. 2*a* depict an exploded and an assembled view, respectively, of a U-channel rocker arm that has a tube assembled into it and which is manufactured in accordance with the invention.
Figure 2A:
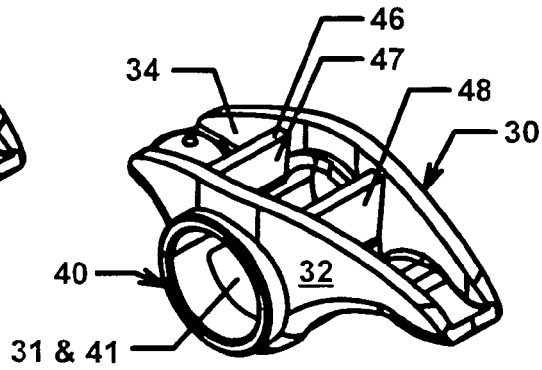

As shown in FIG. 2 and FIG. 2*a* corresponding to the views of prior art FIG. 1*a* and FIG. 1*b*, respectively, the invention is distinguished by the insertion of tube 40 configured as shown and described in detail hereinafter with reference to FIG. 3 and FIG. 4. The tube 40 is provided with an H-shaped slit comprising tabs 42 and 44 utilized in creating cross-members 46 and 48, respectively, as shown in FIG. 2*a*. After inserting the tube 40 into the hole 35 of rocker arm 30 and aligning the bottom window 41 of tube 40 with the window 31 of rocker arm 30, a tool (not shown) is inserted through windows 31 and 41 to bend the tabs 42 and 44 into position, forming the top window 47 and cross members 46 and 48 between the inside walls 32 and 34 of the rocker arm 30. The tube 40 and tabs 42 and 44 are secured by staking and/or brazing/welding to the inside walls of the rocker arm 30.

Figure 3:
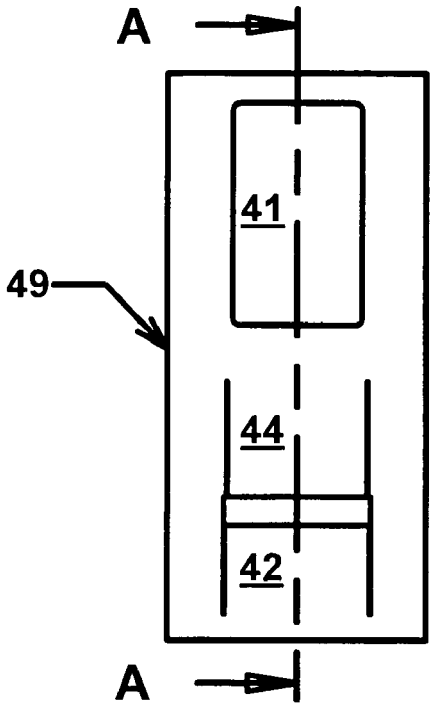
FIG. 3 is a view of the metal blank from which the tube is formed by rolling, showing the lower window and a pair of lanced tabs in an H-configuration.
Figure 3A:
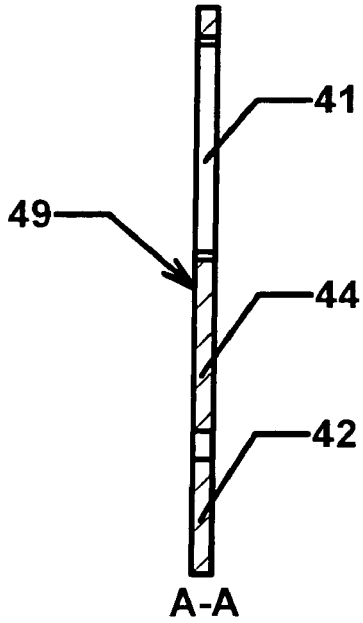
FIG. 3*a* is a cross section taken along line A—A of FIG. 3.
Figure 4:
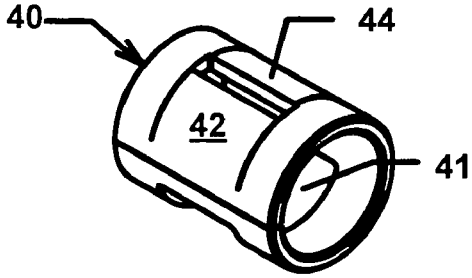
FIG. 4 is a perspective view of the tube formed from the metal blank of FIG. 3.

FIG. 3 and its cross-section FIG. 3*a* depict the sheet metal pattern 49 from which the tube 40 is formed as shown in FIG. 4. Shown are the bottom window 41 and the generally H-shaped slit (for creating two tabs) comprising tabs 42 and 44.

Figure 4A:
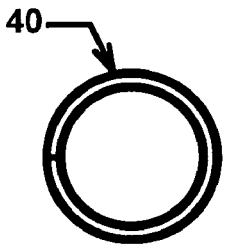
FIG. 4*a* is an end view of FIG. 4.
Figure 4B:
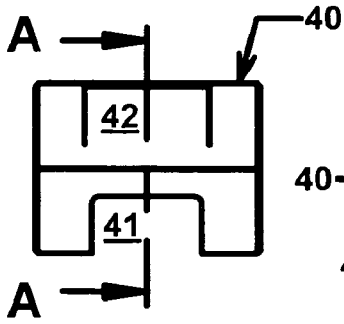
FIG. 4*b* is a side view of FIG. 4.
Figure 4C:
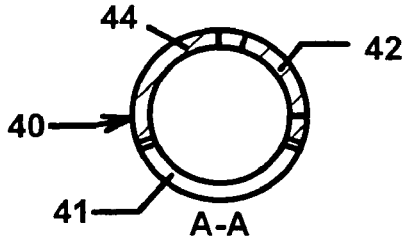
FIG. 4*c* is a sectional view along line A—A of FIG. 4*b*.

FIG. 4, FIG. 4*a*, FIG. 4*b*, and FIG. 4*c* depict the tube 40 (also shown in FIG. 2) made from the flat pattern 49 shown in FIG. 3 and FIG. 3*a*. FIG. 4 is an isometric view of the tube showing the bottom window 41 and the generally H-shaped slit comprising tabs 42 and 44. FIG. 4*a*, FIG. 4*b*, and FIG. 4*c* are respectively end, front, and cross-section views of the tube 40.

Figure 5:
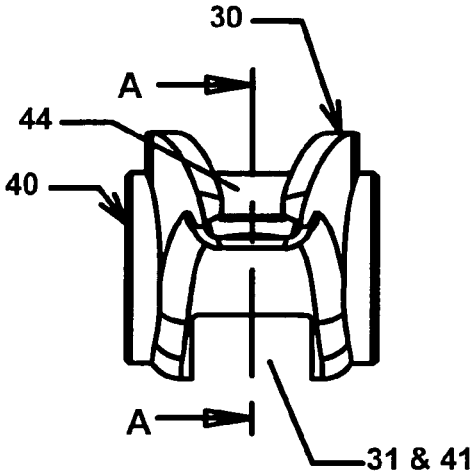
FIG. 5 is an end view of the rocker arm assembly prior to bending the tabs into position.
Figure 5A:
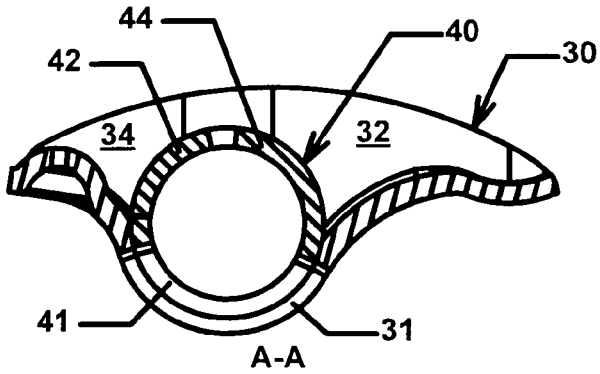
FIG. 5*a* is a sectional view taken along line A—A of FIG. 5
Figure 6:
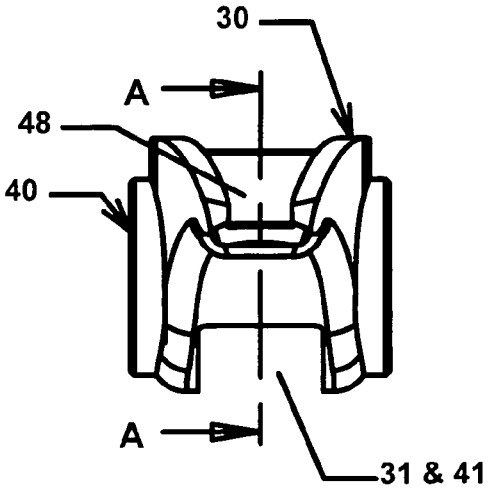
FIG. 6 is an end view of the rocker arm assembly after bending the tabs into position to provide formed-in-place cross-members between the interior sides of the rocker arm.
Figure 6A:
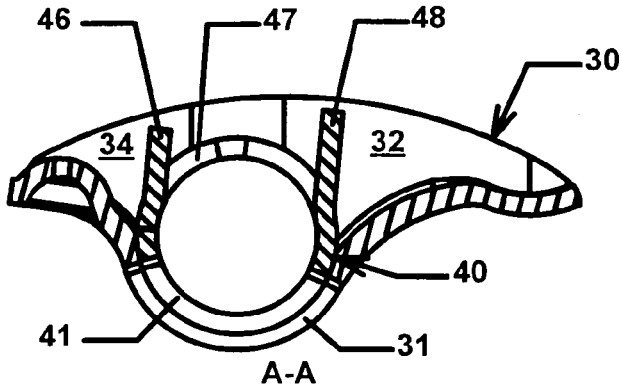
FIG. 6*a* is a sectional view taken along line A—A of FIG. 6.

FIGS. 5 and 6 respectively depict the rocker arm assembly process wherein the tube 40 has been inserted into the rocker arm 30 and subsequently tabs 42 and 44 of the tube 40 are bent into position respectively to form cross-members 46 and 48. FIG. 5 and its cross-section FIG. 5*a* depict the rocker arm 30 with the tube 40 installed, but before the tabs 42 and 44 are bent, with the tube bottom window 41 aligned with the rocker arm window 31. FIG. 6 and its cross-section FIG. 6*a*. depict the rocker arm 30 with the tube 40 tabs 42 and 44 previously shown in FIG. 5*a* bent into position to form cross-members 46 and 48 whose edges respectively abut the interior walls at the push rod end 34 and at the valve end 32 of the rocker arm.

Although the invention has been described in terms of particular embodiments, one skilled in the art will recognize that various changes in the sequence of steps for lancing the sheet metal and securing the tab formed cross member piece and equipment applied in the operative method can be made based on the concept herein provided and such are meant to be included herein. Accordingly, the invention is only to be limited by the scope of the appended claims.

What is claimed is:

1. A method for manufacturing a sheet metal rocker arm having substantially enhanced relative structural integrity and stiffness comprising (a) bending a sheet metal pattern with window openings to form a longitudinal U-channel with straight sides and a connecting U-portion and wherein the openings align when the pattern is bent said sides and having dimensions generally conforming to a rocker arm, said sheet metal pattern having an outer configuration of a shape and size when bent consistent with said dimensions, (b) inserting a metal tubular member into said aligned window openings, said tubular member being provided with slits that pierce through the metal such that a tab is created by said slits, and when said tab is bent;

bending the ends of said tab of the inserted tubular member inwardly into the channel to form a cross member transverse to said sides and such that the ends of said tab abut against the inside of the U-channel sides; and (c) joining said tab ends to the straight sides of the U-channel to integrate said tab and said sides to produce a rigid structure.

2. The method of claim 1 wherein the slit generally comprises a U-shape to produce a single tab yielding a single cross member.

3. A rocker arm formed from the method of claim 2.

4. The method of claim 1 wherein the slit generally comprises an H-shape to produce two tabs to yield a pair of cross members.

5. A rocker arm formed from the method of claim 4.

6. The method of claim 1 wherein the tubular member is seamless tubing.

7. A rocker arm formed from the method of claim 6.

8. The method of claim 1 wherein the tubular member comprises rolled flat steel metal sheeting.

9. A rocker arm formed from the method of claim 8.

* * * * *